US008028373B2

(12) United States Patent
Rowntree

(10) Patent No.: US 8,028,373 B2
(45) Date of Patent: Oct. 4, 2011

(54) VACUUM CLEANERS

(75) Inventor: David Rowntree, Newton Hall (GB)

(73) Assignee: Black & Decker Inc., Newark, DE (US)

( * ) Notice: Subject to any disclaimer, the term of this patent is extended or adjusted under 35 U.S.C. 154(b) by 876 days.

(21) Appl. No.: 12/069,691

(22) Filed: Feb. 12, 2008

(65) Prior Publication Data

US 2009/0019663 A1 Jan. 22, 2009

(30) Foreign Application Priority Data

Feb. 12, 2007 (EP) ..... 07102186

(51) Int. Cl.
*A47L 9/10* (2006.01)

(52) U.S. Cl. ..... 15/347; 15/327.1; 15/344

(58) Field of Classification Search ..... 15/350, 15/344, 347, 327.7, 349, 352, 353
See application file for complete search history.

(56) References Cited

U.S. PATENT DOCUMENTS

| | | | | |
|---|---|---|---|---|
| 1,829,582 | A * | 10/1931 | Carson | 15/347 |
| 1,861,261 | A | 5/1932 | Carson | |
| 2,049,603 | A | 8/1936 | Dietenberger | |
| 2,776,441 | A | 1/1957 | Herriott | |
| 4,052,765 | A | 10/1977 | Guhne et al. | |
| D303,173 | S | 8/1989 | Miyamoto et al. | |
| 5,974,623 | A | 11/1999 | Cummins et al. | |
| 6,012,200 | A * | 1/2000 | Murphy et al. | 15/347 |
| 6,192,550 | B1 | 2/2001 | Hamada et al. | |
| 6,569,218 | B2 | 5/2003 | Dudley | |
| 6,574,831 | B2 * | 6/2003 | Hunter et al. | 15/410 |
| 6,779,229 | B2 * | 8/2004 | Lee et al. | 15/329 |
| 6,941,615 | B2 * | 9/2005 | Shanor et al. | 15/410 |
| D515,756 | S | 2/2006 | Allard et al. | |
| 7,065,826 | B1 | 6/2006 | Arnold | |
| 7,152,276 | B2 | 12/2006 | Jin et al. | |
| 7,152,277 | B2 | 12/2006 | Jung et al. | |
| 7,584,522 | B1 * | 9/2009 | Weeter et al. | 15/350 |
| 7,681,279 | B2 * | 3/2010 | Kelly | 15/323 |
| 2002/0189048 | A1 | 12/2002 | Maruyama et al. | |
| 2002/0194694 | A1 * | 12/2002 | Waldron et al. | 15/323 |
| 2005/0091784 | A1 | 5/2005 | Bone | |
| 2006/0156509 | A1 | 7/2006 | Luebbering et al. | |
| 2007/0033765 | A1 | 2/2007 | Walker et al. | |
| 2007/0067944 | A1 | 3/2007 | Kitamura et al. | |

FOREIGN PATENT DOCUMENTS

| | | |
|---|---|---|
| CA | 2553412 A1 | 2/2007 |
| DE | 3309162 A1 | 9/1984 |

(Continued)

*Primary Examiner* — Dung Van Nguyen
(74) *Attorney, Agent, or Firm* — John Yun

(57) ABSTRACT

A vacuum cleaner (2) having a body (4) having a floorhead (6) and an elongate handle (14) pivotably mounted to the body is disclosed. A door (24) is provided on an end (20) of a collection chamber (12) opposite to a clean air outlet, and a coarse filter (32) and fine filter (46) are located within the collection chamber for separating out debris entrained with dirty air and depositing the debris in the collection chamber. An interior face of the door is provided with radial tangs (68), and an end face (48) of the fine filter is provided with radial tangs (60) such that when the door is closed and the elongate handle is pivoted relative to the body, the fine filter and coarse filter rotate relative to each other to cause cleaning of the filter elements.

17 Claims, 11 Drawing Sheets

FOREIGN PATENT DOCUMENTS

| | | | |
|---|---|---|---|
| DE | 85 19 055 | U1 | 7/1985 |
| EP | 1493374 | A | 1/2005 |
| EP | 1523916 | A | 4/2005 |
| JP | 2001112681 | A | 4/2001 |

* cited by examiner

VACUUM CLEANERS

FIELD OF THE INVENTION

This application claims priority to European Patent Application No. 07102186.9 filed Feb. 12, 2007. The entire contents of that application are expressly incorporated herein by reference thereto.

BACKGROUND OF THE INVENTION

The present invention relates to vacuum cleaners. Such vacuum cleaners are well known for collecting dust and dirt, although wet-and-dry variants which can collect spilled liquids as well are also known. Typically, they are intended for use in a domestic environment, although they also find uses in other environments, such as worksites. Generally, vacuum cleaners are electrically powered and comprise an electric motor, an electrical on-off switch for a user to operate said motor, a fan connected to an output shaft of said motor, an inlet for dirty air, an outlet for clean air and a collection chamber for dust, dirt and possibly also liquids. Electrical power for the motor may be provided by a source of mains electricity, in which case the vacuum cleaner will further comprise an electrical power cable, by a removable and replaceable battery pack, or by one or more in-built rechargeable cells, in which case the vacuum cleaner will further comprise some means, such as a jack plug, for connecting the vacuum cleaner to a recharging unit. When the vacuum cleaner is provided with electrical power from one of these sources and the on-off switch is set to the "on" position, the electric motor drives the fan to draw dirty air along an airflow pathway in through the dirty air inlet, via the collection chamber to the clean air outlet. Interposed at some point along the airflow pathway, there is also provided some means for separating out dust and dirt (and possibly also liquids) entrained with the dirty air and depositing these in the collection chamber. This separation means may comprise one or more filters and/or a cyclonic separation device. An example of such a hand-holdable vacuum cleaner in which the separation means comprises a filter is disclosed in European patent application No. EP 1 523 916 in the name of the present applicant.

BRIEF SUMMARY OF THE INVENTION

Accordingly, the present invention has as its object the provision of an improved vacuum cleaner enabling easy cleaning of a filter of the vacuum cleaner by a user.

According to an aspect of the present invention, there is provided a vacuum cleaner comprising a body having a floorhead for engaging a floor, wherein the floorhead has a first inlet for dirty air; an elongate handle for gripping by a user and pivotably mounted to the body; an electric motor located in the body; an electrical on-off switch for operating the motor; a fan connected to an output shaft of the motor; an airflow path comprising a second inlet for dirty air, an outlet for clean air, and a collection chamber located in fluid communication between said second inlet and said outlet; a door provided on an end of the collection chamber opposite to the clean air outlet; and a filter located within the collection chamber for separating out debris entrained with dirty air entering via said second inlet and depositing the debris in said collection chamber; wherein an interior face of the door is provided with first engaging portions, and an end face of the filter adjacent to the interior face of the door is provided with second engaging means such that when the door is closed and the elongate handle is pivoted relative to the body, the first and second engaging portions engage each other to cause at least part of the filter to rotate relative to the body.

By providing an interior face of the door with first engaging portions, and an end face of the filter adjacent to the interior face of the door with second engaging portions such that when the door is closed and the elongate handle is pivoted relative to the body, the first and second engaging portions engage each other to cause at least part of the filter to rotate relative to the body, this provides the advantage of automatically causing agitation of the filter to release debris therefrom when the user pivots the elongate handle to fold the vacuum cleaner for storage and/or unfold it for use.

In a first preferred embodiment, at least part of the filter located within the collection chamber is rotatable relative to the door when the elongate handle is pivoted relative to the body; the first engaging portions comprise a series of radial tangs; the second engaging portions comprise a corresponding set of radial tangs; and the combined height of the tangs on the interior face of the door and on the end face of the filter is greater than the separation between the interior face of the door and the end face of the filter.

If the combined height of the tangs on the interior face of the door and on the end face of the filter is greater than the separation between the interior face of the door and the end face of the filter, the two facing sets of tangs will overlap each other, such that when the pivotable nose is rotated relative to main axis of the vacuum cleaner, the tangs of the filter will engage with the tangs on the door and agitate the filter, thereby dislodging dust and dirt adhering to the filter and causing it to be deposited in the collection chamber. This filter cleaning mechanism has the advantage that it allows the filter to be cleaned by a user merely pivoting the nose of the vacuum cleaner relative to the main body thereof and without the need to touch the dirty filter at all.

In a second preferred embodiment, at least part of the filter is held immovable relative to the main body of the vacuum cleaner during operation thereof; the door is rotatable relative to at least part of the filter when the elongate handle is pivoted relative to the body; the first engaging portions comprise a series of radial tangs; the second engaging portions comprise a corresponding set of radial tangs; and the combined height of the tangs on the interior face of the door and on the end face of the filter is greater than the separation between the interior face of the door and the end face of the filter.

The filter may comprise a coarse filter rotatably mounted to a fine filter wherein the coarse filter and fine filter have mutually engaging protrusions adapted to cause agitation of said filter when said coarse filter and fine filter are rotated relative to each other as a result of pivoting of the elongate handle relative to the body.

This provides the advantage of enabling the mechanism for agitating the filter to be of simple construction and easy to assemble.

The mutually engaging protrusions may comprise at least one rib on one of the coarse filter and fine filter and a plurality of ridges on the other of the coarse filter and fine filter.

The coarse filter and fine filter may be hollow and substantially cylindrical such that one of the coarse filter and fine filter is located over the motor and is substantially enclosed by the other of the coarse filter and fine filter.

This provides the advantage of enabling the body of the vacuum cleaner containing the collection chamber to be of compact construction.

The coarse filter may substantially enclose the fine filter.

This provides the advantage of enabling the body of the vacuum cleaner to be of further compact construction and using fewer parts, since the generally more robust coarse filter can be used to locate the generally less robust fine filter medium in position without the necessity of providing further reinforcement for the fine filter medium.

The elongate handle may be pivotable relative to the body between a folded condition, in which the handle is folded against the body, and at least one unfolded condition.

This provides the advantage of enabling the vacuum cleaner to be made particularly compact for storage purposes, as well as enabling the angle of the handle relative to the floorhead to be adjusted, improving the ease of use of the vacuum cleaner.

The elongate handle may be pivotable relative to the body through an angle of at least 225 degrees.

The elongate handle may be pivotable relative to the body through an angle of at least 270 degrees.

In a preferred embodiment, the floorhead or a part of the vacuum cleaner rigidly connected thereto comprises first engagement means; a part of the vacuum cleaner rigidly connected to a main body thereof housing the motor and the fan comprises second engagement means adapted to engage with said first engagement means; and the vacuum cleaner further comprises a resiliently biased button operable to disengage the first engagement means from the second engagement means.

In a preferred embodiment, the collection chamber has a substantially cylindrical shape about a central axis oriented at right angles to a main axis of the vacuum cleaner; the filter is arranged in an axially symmetric fashion concentric with the central axis of the collection chamber; the elongate handle is arranged to pivot about the central axis of the collection chamber; a dirty air outlet from the floorhead is arranged to enter the collection chamber on a cylindrical side wall thereof; and a clean air outlet from the collection chamber is located within said filter.

The filter may have a conical or frusto-conical shape.

The door may be held by the body of the vacuum cleaner which houses the motor and the fan.

Notwithstanding the foregoing, the filter may still be removable and replaceable when the vacuum cleaner is not in use, so that a worn, damaged or permanently clogged filter may be substituted by a new one.

The filter may also comprise a plurality of filter elements, such as a course filter for filtering larger particles of dirt and a fine filter contained therein for filtering finer particles of dust from the airflow pathway. The filter elements may themselves be independently removable and replaceable.

In embodiments in which the collection chamber has a substantially cylindrical shape about a central axis oriented at right angles to the main axis of the vacuum cleaner, it is also preferable for the motor and the fan to be oriented in the body of the vacuum cleaner with the output shaft of the motor and the fan's axis of rotation parallel to a central axis of the collection chamber and at right angles to a main axis of the vacuum cleaner. This new arrangement has several advantages over the conventional layout, as follows. Firstly, it is beneficial for the overall compactness of the vacuum cleaner, considering that the collection chamber is already oriented at right angles to the main axis of the vacuum cleaner. Secondly, it means that the fan can be located on the same side of the vacuum cleaner as the clean air outlet from the collection chamber and in close proximity thereto, thereby shortening the airflow pathway between these two components, which improves the overall speed and efficiency of the vacuum cleaner in operation. Thirdly, if the fan is configured as an impeller which draws air in axially thereto and expels air out radially therefrom, the main body of the vacuum cleaner can also be provided with one or more exhaust vents on the rear of the main body, i.e. in a location opposite to the second inlet. In this way, air expelled by the fan will travel in a straight-line path from the fan to the exhaust vents without having to be directed around any corners, but is nonetheless also directed away from a surface to be cleaned in completely the opposite direction to the dirty air inlet to the floorhead, which avoids disturbing dust and dirt on the surface to be cleaned with the exhausted air.

The vacuum cleaner may be a rechargeable model.

The floorhead of the vacuum cleaner may be provided with an one-way valve in the form of a flap composed of a resilient material, such as rubber, which allows dirty air to enter the floorhead via the dirty air inlet when the vacuum cleaner is in operation, but which prevents dust and dirt from leaving the floorhead via the dirty air inlet under the influence of gravity when the vacuum cleaner is not in operation.

According to another aspect of the present invention, there is provided a recharging unit adapted to recharge a vacuum cleaner as defined above.

BRIEF DESCRIPTION OF THE INVENTION

A preferred embodiment of the invention will now be described, by way of example only and not in any limitative sense, with reference to the accompanying drawings, in which:

FIG. 5 is a detailed view of the body and floorhead of the vacuum cleaner of

Figure 1:
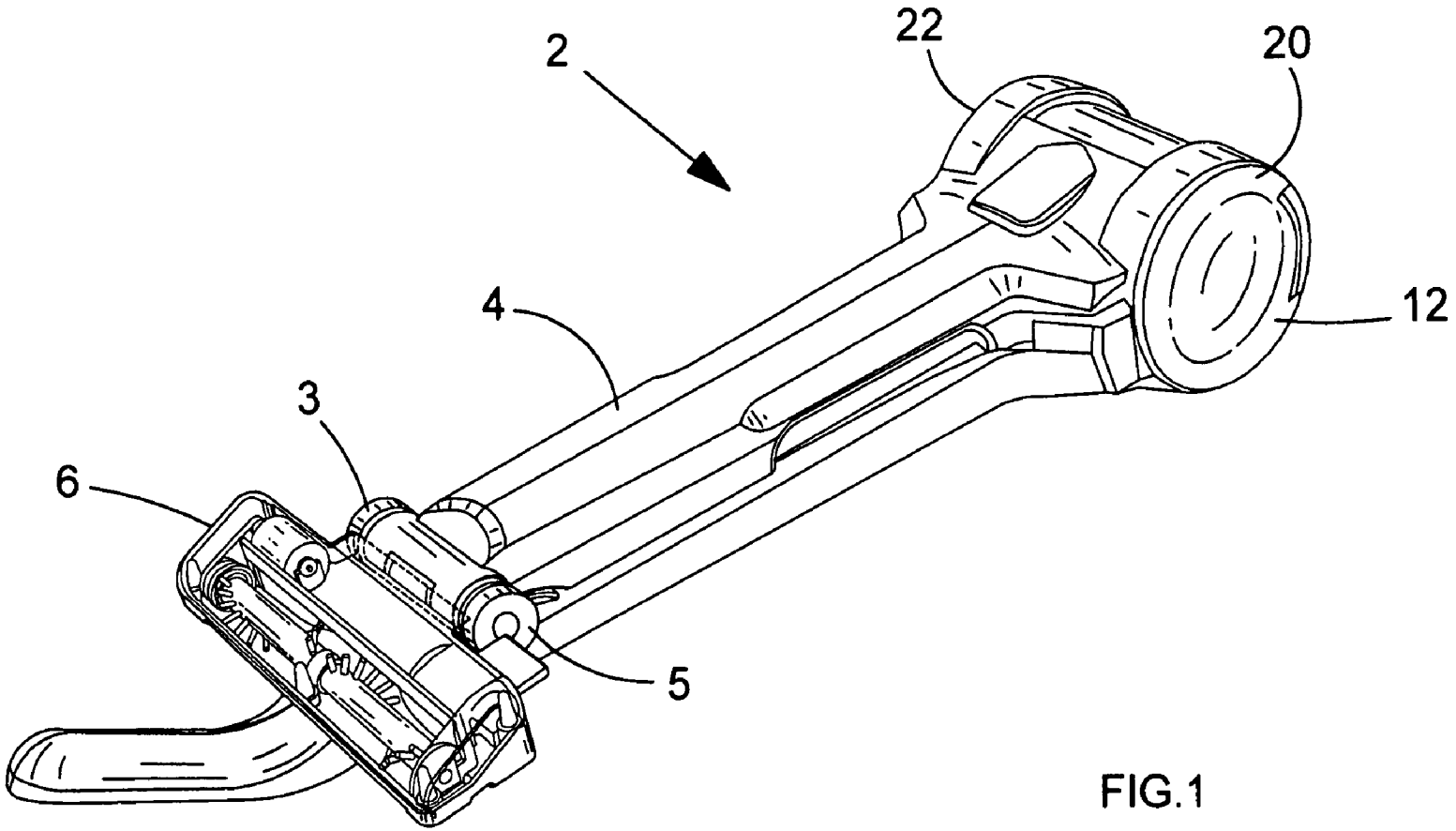
FIG. 1 shows a vacuum cleaner embodying the present invention in a folded condition.
Figure 2:
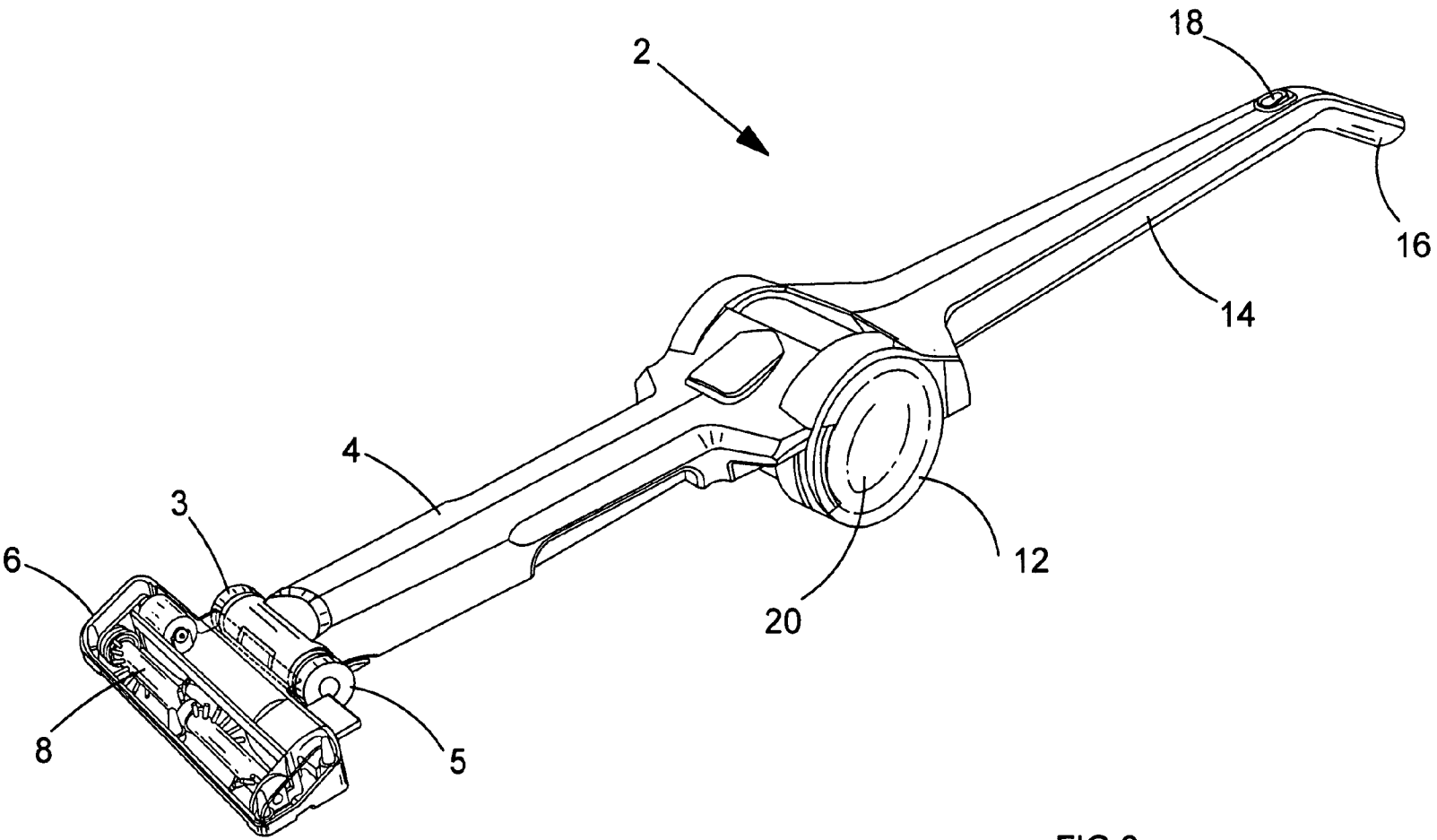
FIG. 2 shows the vacuum cleaner of FIG. 1 in a first unfolded condition.
Figure 3:
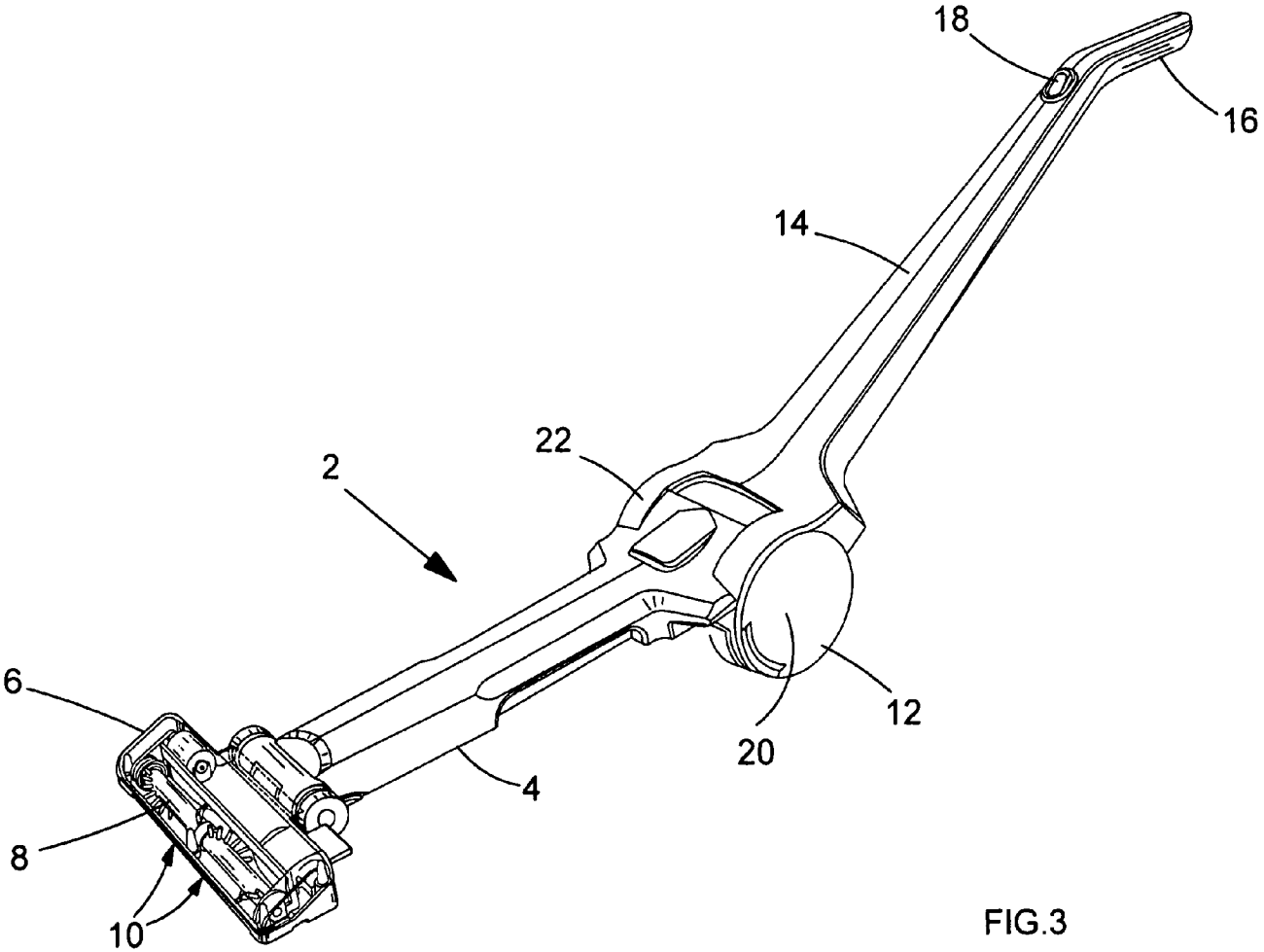
FIG. 3 shows the vacuum cleaner of FIG. 1 in a second unfolded condition.
Figure 6:
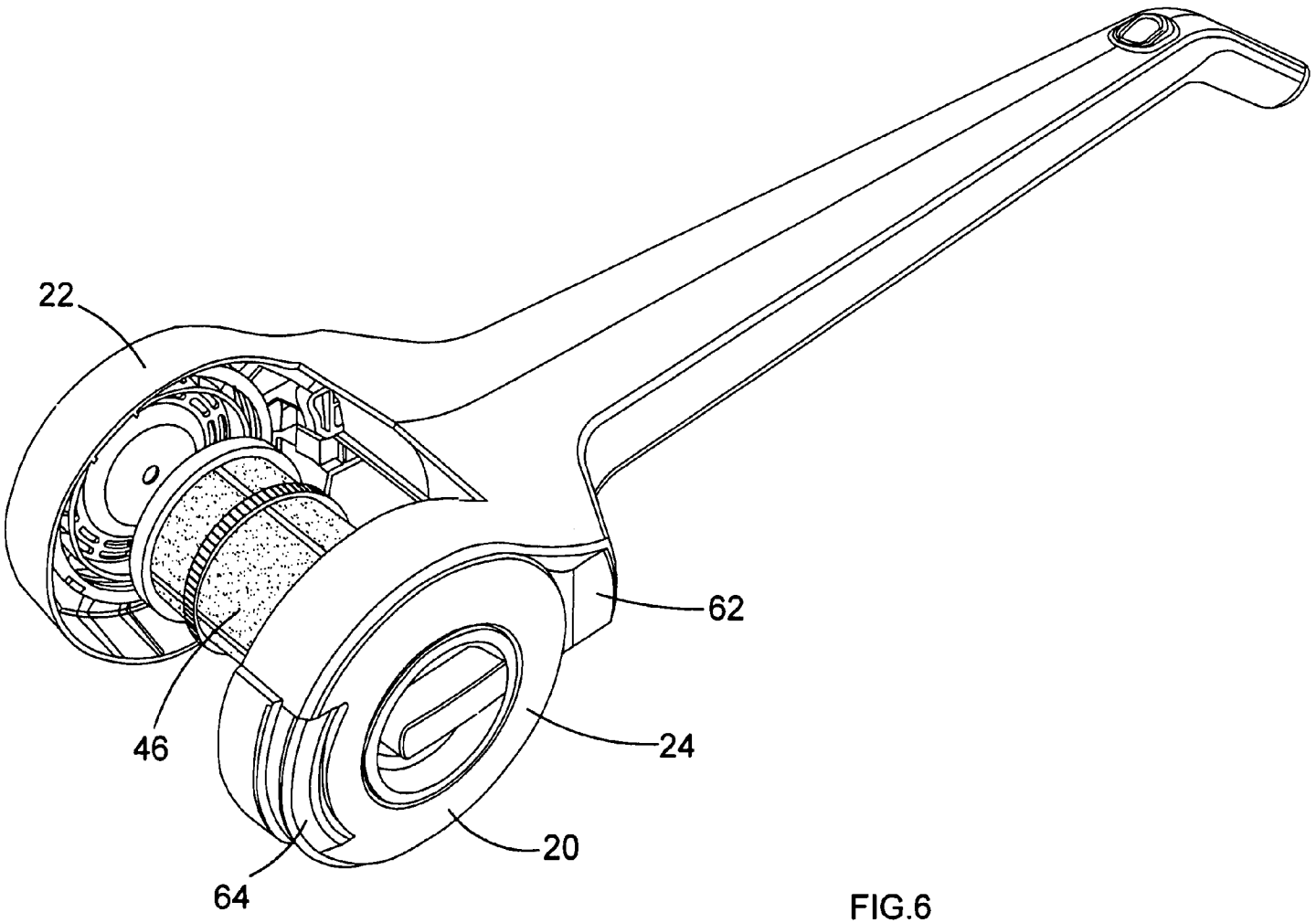
Figure 7:
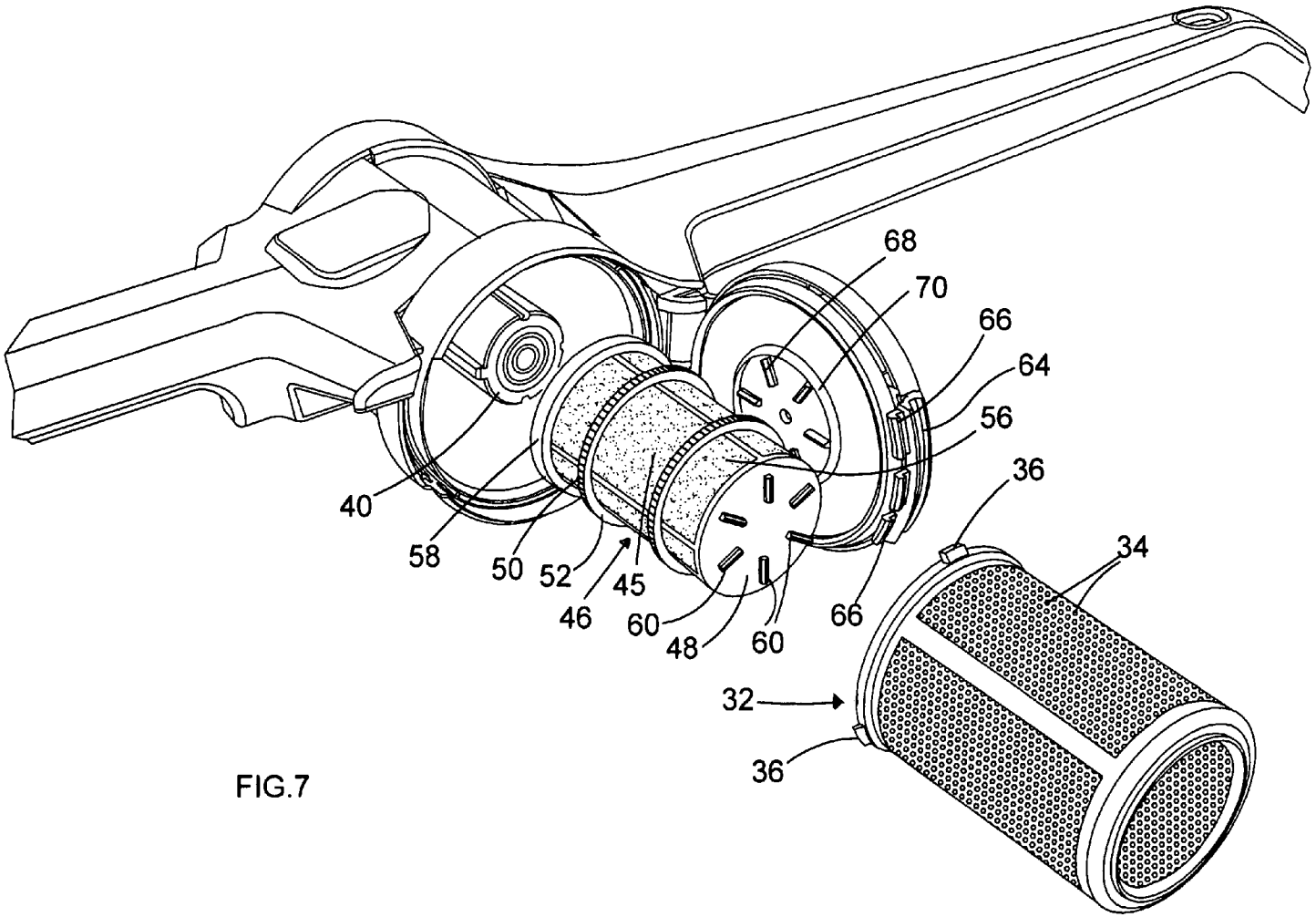
Figure 8:
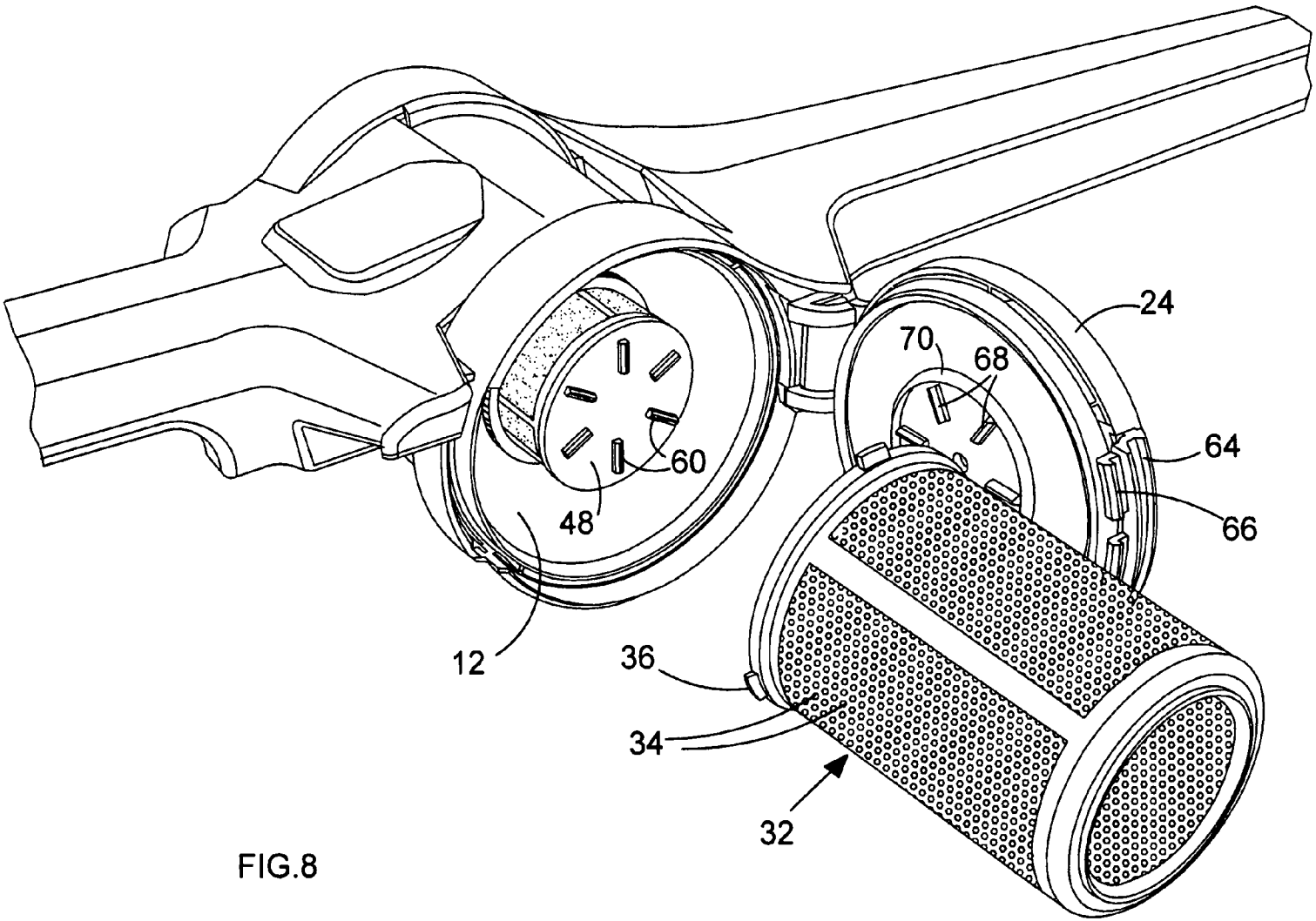
Figure 9:
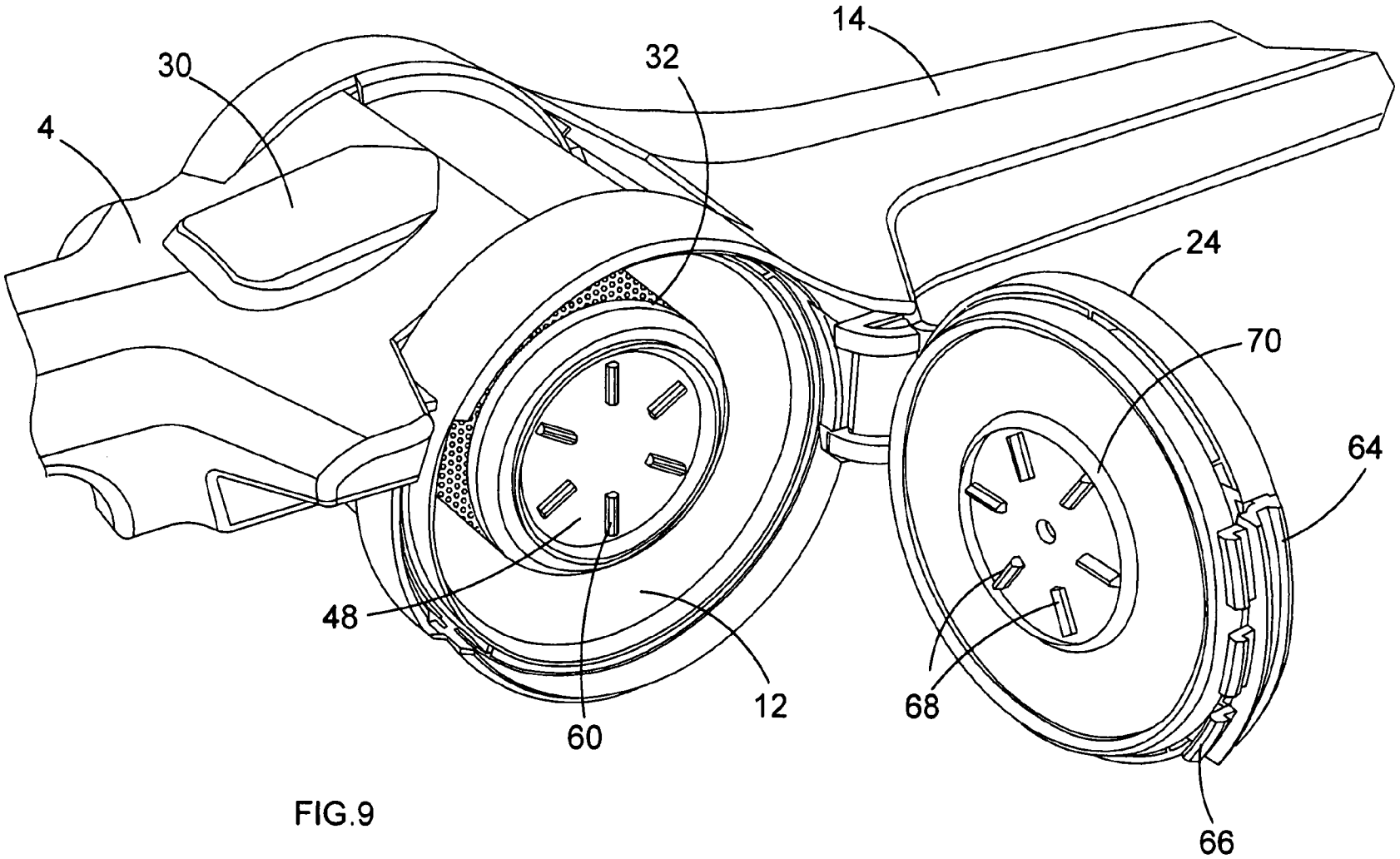
Figure 10:
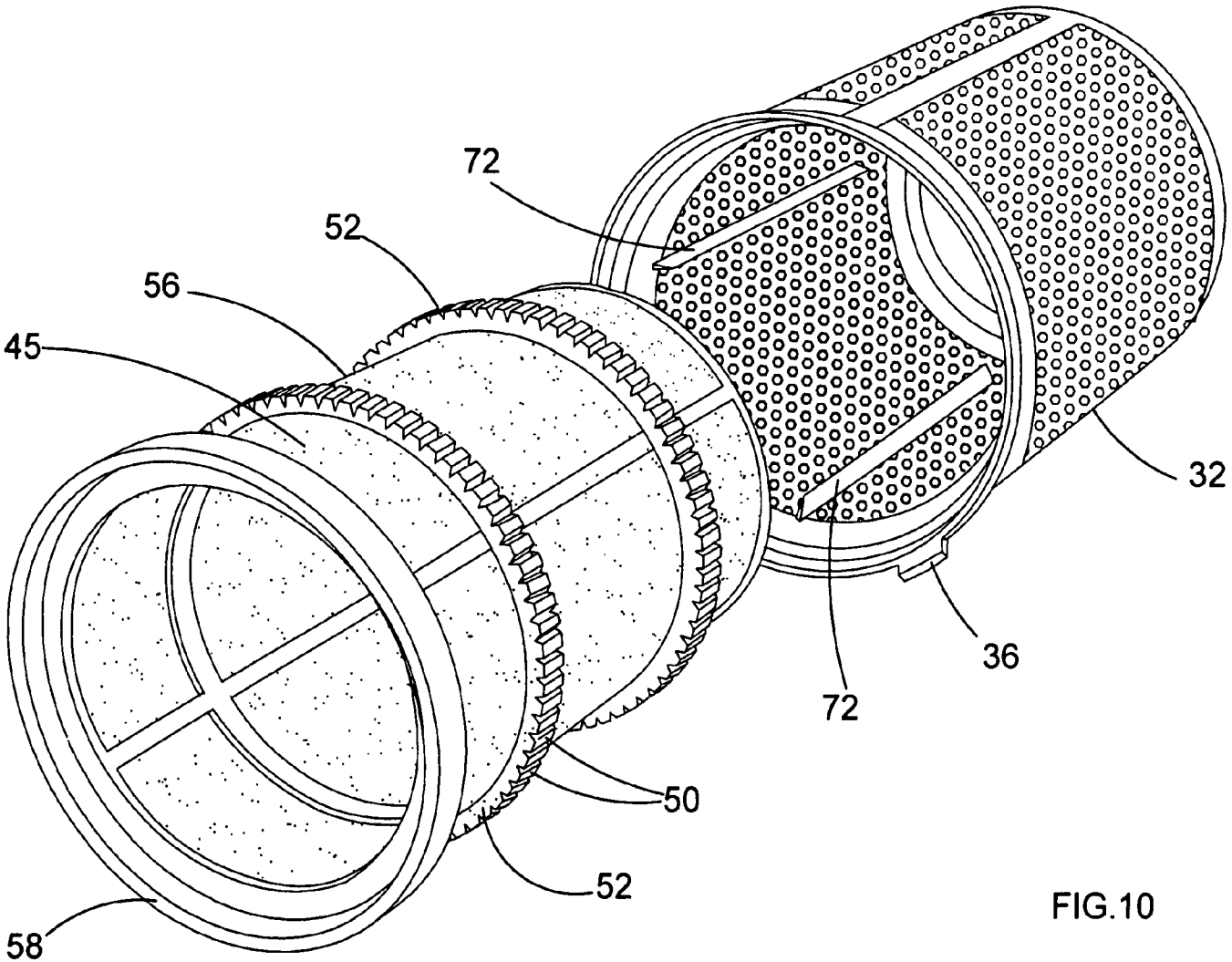

FIG. 1;

FIG. 6 is a detailed view of the elongate handle of the vacuum cleaner of FIG. 1;

FIG. 7 is a detailed view of the collection chamber of the vacuum cleaner in the condition shown in FIG. 2 with the door open and the fine filter and coarse filter removed from the collection chamber;

FIG. 8 is a detailed view of the collection chamber with the fine filter in position and the coarse filter removed;

FIG. 9 is a detailed view of the collection chamber with the fine and coarse filters in position and the door open;

FIG. 10 is a perspective view of the fine and coarse filters; and

Figure 11:
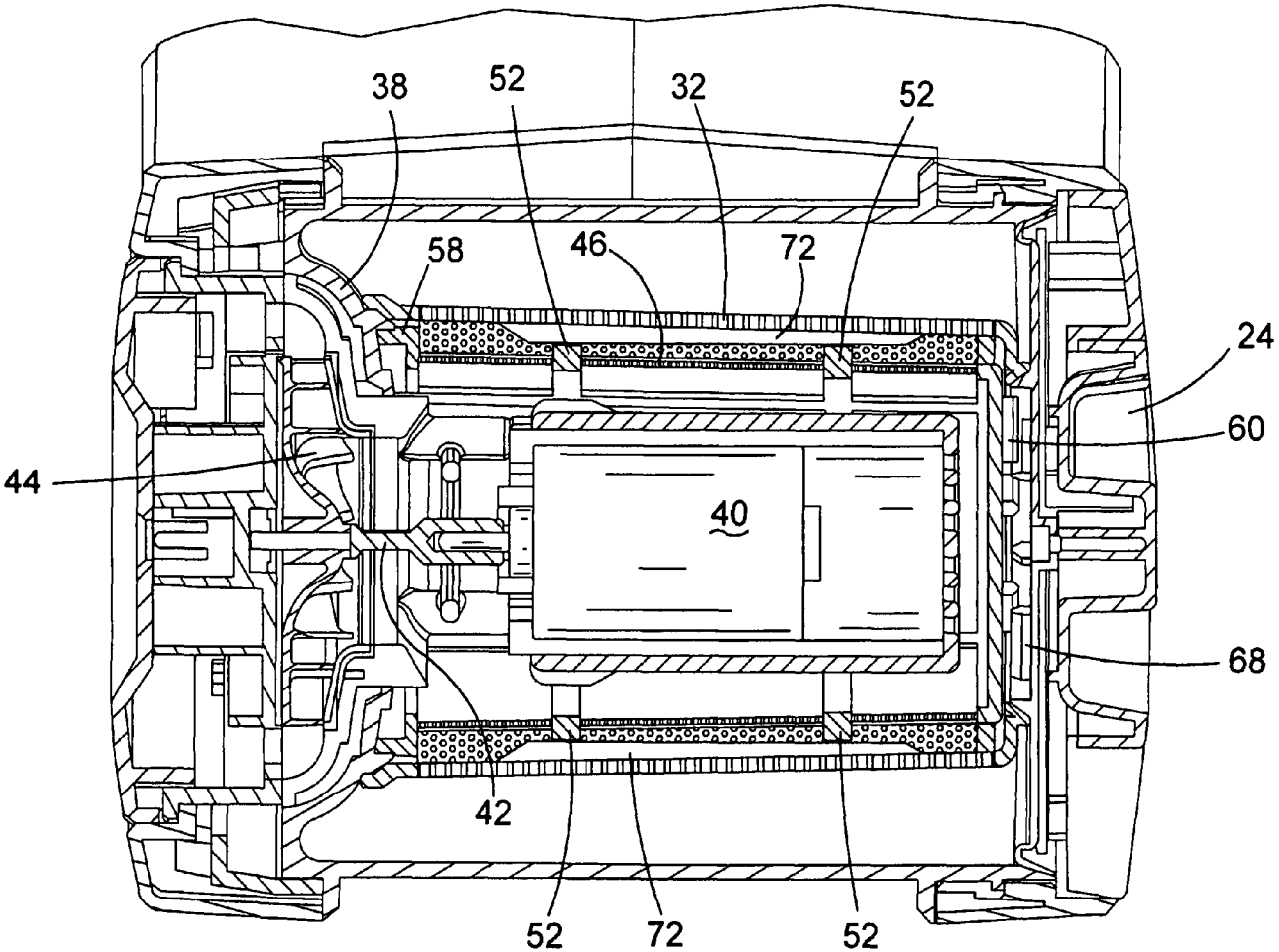

FIG. 11 is a cross sectional view of the part of the body of the vacuum cleaner containing the collection chamber and fine and coarse filters.

DETAILED DESCRIPTION OF THE INVENTION

Figure 4:
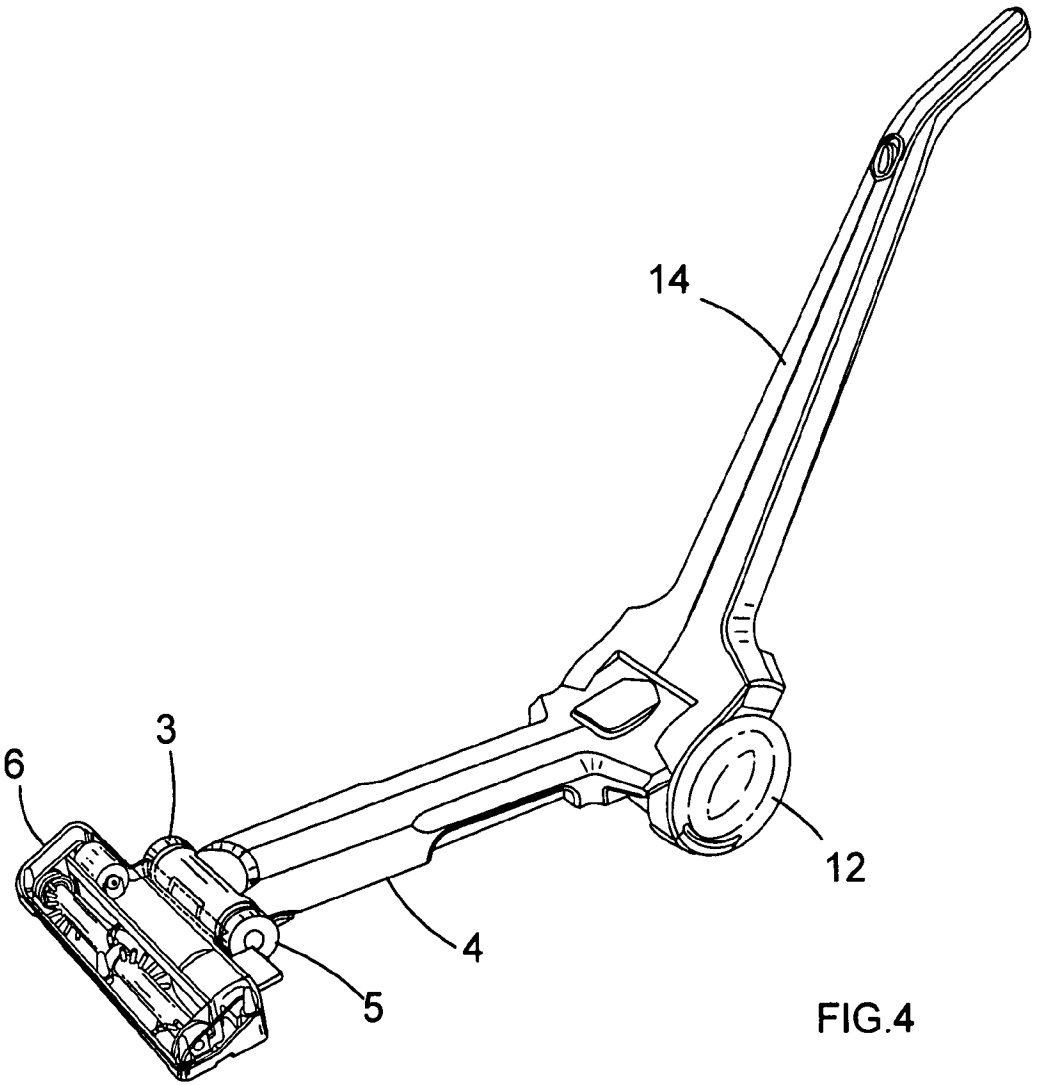
FIG. 4 shows the vacuum cleaner of FIG. 1 in a third unfolded condition.

As shown in FIGS. 1 to 6, a vacuum cleaner 2 has a body 4 to which a floorhead 6 containing a brush 8 and a first inlet 10 (FIG. 5) for dirty air is pivotably connected at one end and a cylindrical collection chamber 12 is defined at the other end. An elongate handle 14 having a grip 16 and an on/off switch 18 at one end has a pair of opposing end faces 20, 22 and a door 24 at the other end so that the handle 14 can be pivotably mounted to the body 4 for pivoting movement between a folded condition as shown in FIG. 1 in which the underside of the elongate handle 14 abuts the underside of the floorhead 6, a first unfolded condition as shown in FIG. 2 in which the elongate handle 14 is arranged at approximately 180 degrees to the body 4, a second unfolded condition shown in FIG. 3 in which the elongate handle 14 is at approximately 225 degrees to the body 4, and a third unfolded condition as shown in FIG. 4 in which the handle 14 is at approximately 270 degrees to the body 4, for example for cleaning underneath furniture. The floor head 6 further comprises a pair of ground engaging wheels 3 and 5.

Figure 5:
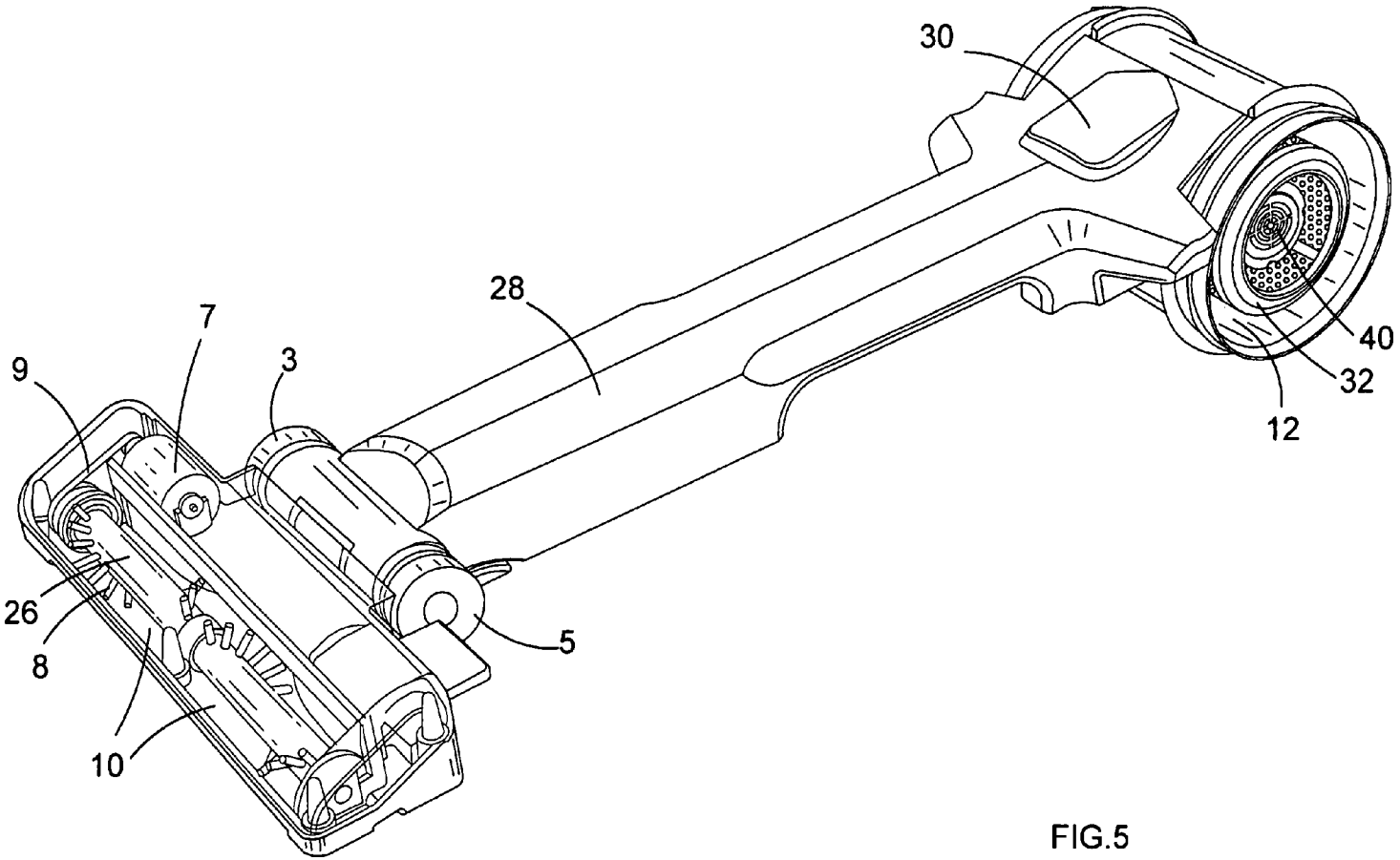

As shown in greater detail in FIG. 5, the floorhead 6 has a spiral brush 8 mounted to an axle 26, and a first inlet 10 for dirty air which is connected via an internal conduit 28 to a generally second dirty air inlet 30 arranged generally tangentially to cylindrical collection chamber 12. A secondary motor 7 located in floorhead 6 drives axle 26 and hence brush 8 in a rotating motion via a drive belt 9. Referring to FIG. 7, a coarse filter element 32 consisting of a generally cylindrical member having holes 34 in a side surface thereof is non-rotatably attached to the collection chamber 12 by means of protrusions 36 which engage corresponding slots on an interior end wall 38 (FIG. 11) of the collection chamber 12. The collection chamber 12 also contains an electric motor 40 having an output shaft 42 carrying an impeller fan 44 arranged to displace air radially outwards from its axis of rotation.

As shown in FIG. 7, a fine filter element 46 consisting of a hollow cylinder, closed at one end 48 and having ridges 50 provided on a pair of cylindrical collars 52, and a fine filter medium 45 arranged on its outer surface 56 is rotatably attached by means of a circular flange 58 to the interior end wall 38 of the collection chamber 12. An outer face of the closed end 48 of the fine filter element 46 opposite to the circular flange 58 carries a series of radially extending tangs 60, the function of which will be described in greater detail below.

Referring again to FIG. 6, one of the end faces 20 provided on the elongate handle 14 at the end thereof remote from the grip 16 has a door 24 which can be pivoted outwards about a hinge 62 by depressing a spring loaded catch 64 radially inwards to release door latches 66, best seen in FIG. 7, in order to provide access to the collection chamber 12 for emptying debris from the collection chamber 12 or cleaning or replacing the filter elements 32, 46. The internal surface of the door 24 is provided with a series of radially extending tangs 68 surrounded by a flange 70 for engaging the end face 48 of the fine filter element 46 such that when the fine filter element 46 is in place in the collection chamber 12 and the door 24 is closed, the total height of the fine filter element 46 and its radial tangs 60 and that of the radial tangs 68 on the internal surface of the door 24 is greater than the distance between the interior end face 38 of the collection chamber 12 and the other end face defined by the internal surface of the door 24 when in the closed position. As a result, as the door 24 is rotated with the elongate handle 14 as it is rotated relative to the body 4, the radial tangs 68 on the inside surface of the door 24 engage the radial tangs 60 on the end surface 48 of the fine filter element 46 and cause it to rotate relative to the body 4.

The coarse filter element 32 is provided with ribs 72 on its internal surface (FIG. 10) which engage the ridges 52 and fine filter medium 45 on the external surface of the fine filter element 46, so that as the fine filter element 46 and coarse filter element 32 are rotated relative to each other, as a result of pivoting of the handle 14 relative to the body 4, the ribs 72 on the internal surface of the coarse filter element 32 agitate the fine filter element 46 to release debris trapped on the fine filter medium and also agitate the coarse filter element 32 to release some of the debris trapped in the holes 34 of the coarse filter element 32.

The fine filter element 46 surrounds the electric motor 40, and is in turn surrounded by the coarse filter element 32 in order to enable a compact construction of the vacuum cleaner.

The operation of the vacuum cleaner will now be described.

As the vacuum cleaner is unfolded from its initial folded condition for compact storage shown in FIG. 1, the door 24 rotates with the handle 14 until the tangs 68 on the inner surface of the door 24 engage the tangs 60 on the end surface 48 of the fine filter element 46, to cause the fine filter element 46 to rotate relative to the coarse filter element 32, which is non-rotatably fixed to the body 4 by means of protrusions 36. As the handle 14 is pivoted relative to the body 4 to one of the unfolded conditions shown in FIGS. 2 to 4, this therefore carries out cleaning of at least the fine filter element 46 and/or also of the coarse filter element 32 without the inconvenience of any dedicated cleaning action being undertaken by the user.

Actuation of the electrical on/off switch 18 causes rotation of the impeller fan 44, which drives air radially outwards out of clean air outlets of the body 4. This in turn creates a suction which draws dirty air through the inlet 10 of the floorhead 6 along the conduit 28 where it is tangentially introduced through inlet 30 into the collection chamber 12. Actuation of the electrical on/off switch 18 simultaneously also causes operation of the secondary motor 7 located in the floorhead, which by rotating spiral brush 8 via drive belt 9, increases pick-up of dirt. From inlet 30, the dirty air is then caused to circulate around the outer surface of the coarse filter element 32, and larger particles of debris are deposited in the collection chamber 12. Partially cleaned air then passes through the holes 34 in the coarse filter element 32 and passes through the fine filter medium 45 of the fine filter element 46, where it then reaches the impeller fan 44 and is expelled out of the clean air outlets. After use, the vacuum cleaner is switched off and the handle 14 is pivoted back to the storage condition shown in FIG. 1, which causes further cleaning of the filter elements 32, 46.

In order to clean or replace the filters elements 32, 46, the door 24 is opened by pressing the catch 64 radially inwards to release latches 66, and pivoting the door 24 outwards about hinge 62. Debris can then be emptied from the collection chamber 12. The coarse filter element 32 can be removed for cleaning from the collection chamber 12 by resiliently disengaging its projections 36 from the corresponding slots in the interior end wall 38 of the collection chamber 12. The fine filter element 46 can also be removed and the fine filter medium 45 replaced if necessary.

It will be appreciated by persons skilled in the art that the above embodiment has been described by way of example only, and not in any limitative sense, and that various alterations and modifications are possible without departure from the scope of the invention as defined by the appended claims. For example, the radially extending tangs 60, 68 provided on the fine filter element 46 and door 24 can be replaced by any suitable means for causing the fine filter element 46 to rotate with the door 24, for example pins engaging slots forming parts of circular arcs. Moreover, although the above description details an embodiment in which the course filter element 32 is attached to the body 4 of the vacuum cleaner and the fine filter element 46 is caused to rotate relative to the course filter element when the handle 14 is pivoted relative to the body 4, in an alternative embodiment, this situation may be reversed, such that the fine filter element 46 attached to the body 4 of the vacuum cleaner and the course filter element 32 is instead caused to rotate relative to the fine filter element when the handle 14 is pivoted relative to the body 4.

The invention claimed is:

1. A vacuum cleaner comprising:

a body having a floorhead for engaging a floor, wherein the floorhead has a first inlet for dirty air;

an elongate handle for gripping by a user and pivotably mounted to the body;

an electric motor located in the body or the handle;

an electrical on-off switch for operating the motor;

a fan connected to an output shaft of the motor;

an airflow path comprising a second inlet for dirty air, an outlet for clean air, and a collection chamber located in fluid communication between said second inlet and said outlet;

the collection chamber having a door and a filter located within the collection chamber for separating out debris entrained with dirty air entering via said second inlet and depositing the debris in said collection chamber;

wherein an interior face of the door is provided with first engaging portions, and an end face of the filter adjacent to the interior face of the door is provided with second engaging portions such that when the door is closed and the elongate handle is pivoted relative to the body, the first and second engaging portions engage each other to cause at least part of the filter to rotate relative to the body.

2. The vacuum cleaner according to claim 1, wherein:

at least part of the filter is held immovable relative to the main body of the vacuum cleaner during operation thereof;

the door is rotatable relative to at least part of the filter when the elongate handle is pivoted relative to the body;

the first engaging portions comprise a series of radial tangs;

the second engaging portions comprise a corresponding set of radial tangs; and the combined height of the tangs on the interior face of the door and on the end face of the filter is greater than the separation between the interior face of the door and the end face of the filter.

3. The vacuum cleaner according to claim 1, wherein the filter comprises a coarse filter rotatably mounted to a fine filter, the coarse filter and fine filter have mutually engaging protrusions adapted to cause agitation of both filters when said coarse filter and fine filter are rotated relative to each other as a result of pivoting of the elongate handle relative to the body.

4. The vacuum cleaner according to claim 3, wherein said mutually engaging protrusions comprise at least one rib on one of the coarse filter and fine filter and a plurality of ridges on the other of the coarse filter and fine filter.

5. The vacuum cleaner according to claim 3, wherein the coarse filter and fine filter are hollow and substantially cylindrical such that the fine filter is located over the motor and the coarse filter is located over the fine filter.

6. The vacuum cleaner according to claim 1, wherein the elongate handle is pivotable relative to the body between a folded condition, in which the handle is folded against the body, and an unfolded condition.

7. The vacuum cleaner according to claim 6, wherein the elongate handle is pivotable relative to the body through an angle of at least 270 degrees.

8. The vacuum cleaner according to claim 1, wherein:

the collection chamber has a substantially cylindrical shape about a central axis oriented at right angles to a main axis of the vacuum cleaner;

the filter is arranged in an axially symmetric fashion concentric with the central axis of the collection chamber;

the elongate handle is arranged to pivot about the central axis of the collection chamber;

a dirty air inlet for the collection chamber located on a cylindrical side wall thereof; and a clean air outlet from the collection chamber is located within said filter.

9. The vacuum cleaner according to claim 1, wherein the filter is replaceable.

10. The vacuum cleaner according to claim 1, wherein the filter comprise a plurality of filter elements.

11. The vacuum cleaner according to claim 1, wherein the motor and the fan are oriented in the body of the vacuum cleaner with the output shaft of the motor and the fan's axis of rotation parallel to a central axis of the collection chamber and at right angles to a main axis of the vacuum cleaner.

12. The vacuum cleaner according to claim 1, wherein the vacuum cleaner includes a rechargeable battery.

13. A vacuum cleaner comprising:

a body having a floorhead on a first end, the floorhead having a dirty air inlet;

a handle pivotably connected to a second end of the body;

a collection chamber providing the connection between handle and the body and being in fluid communication with the dirty air inlet, wherein the handle and the body rotate relative to one another about the collection chamber;

a motor and impeller for providing a suction force for the dirty air inlet;

wherein the collection chamber is substantially at the midpoint of the vacuum cleaner;

wherein the motor is located in the collection chamber; and an air filter surrounding the motor.

14. The vacuum cleaner of claim 13, wherein the air filter comprises a fine air filter and a coarse air filter, the fine air filter being located over the motor and the coarse air filter being located over the fine air filter.

15. The vacuum cleaner of claim 14, wherein the collection chamber is fixed to one of the body or handle, and the door is fixed to the other of the body or handle and so rotates relative thereto, the door having radial tangs that engage corresponding tangs on the coarse air filter, the fine air filter being secured to the collection chamber and having ridges thereon that engage the coarse air filter so that upon rotation of the door, the coarse air filter rotates relative to the fine air filter and agitates the fine air filter.

16. The vacuum cleaner of claim 13 wherein the collection chamber is fixed to one of the body or the handle, the collection chamber having a door that is fixed to the other of the body or handle; and an air filter located inside the collection chamber and being agitated upon rotation of the handle relative to the body.

17. The vacuum cleaner of claim 16 wherein the door includes radial tangs on an interior surface which engage corresponding tangs on the air filter so that when the door is rotated, the air filter is agitated.

* * * * *